United States Patent [19]

Hara et al.

[11] 4,375,388

[45] Mar. 1, 1983

[54] APPARATUS FOR FILLING CARBONIZING CHAMBER OF COKE OVEN WITH POWERED COAL WITH VIBRATION APPLIED THERETO

[75] Inventors: Hisanori Hara; Takafumi Kawamura, both of Kitakyushu; Osamu Takamori; Wako Ieko, both of Tokai, all of Japan

[73] Assignee: Nippon Steel Corporation, Tokyo, Japan

[21] Appl. No.: 306,935

[22] Filed: Sep. 29, 1981

Related U.S. Application Data

[62] Division of Ser. No. 199,038, Oct. 20, 1980, abandoned.

[30] Foreign Application Priority Data

| | | | |
|---|---|---|---|
| Oct. 23, 1979 | [JP] | Japan | 54-136785 |
| Aug. 14, 1980 | [JP] | Japan | 55-112111 |
| Sep. 11, 1980 | [JP] | Japan | 55-126304 |
| Sep. 11, 1980 | [JP] | Japan | 55-126306 |
| Sep. 11, 1980 | [JP] | Japan | 55-126307 |

[51] Int. Cl.[3] ..... C10B 37/02; C10B 37/04

[52] U.S. Cl. ..... 202/239; 202/262; 202/270; 414/586; 414/587

[58] Field of Search ..... 201/40, 5; 202/262, 202/239, 270; 414/586, 587

[56] References Cited

U.S. PATENT DOCUMENTS

| | | | |
|---|---|---|---|
| 2,002,614 | 5/1935 | Petsch | 201/40 |
| 2,018,664 | 10/1935 | Fitz et al. | 201/40 |
| 2,676,915 | 4/1954 | Dupre | 201/40 |
| 3,515,293 | 6/1970 | Cain | 202/262 |

FOREIGN PATENT DOCUMENTS

| | | | |
|---|---|---|---|
| 227470 | 1/1926 | United Kingdom | 201/40 |
| 362782 | 12/1931 | United Kingdom | 201/40 |

*Primary Examiner*—Bradley Garris

*Attorney, Agent, or Firm*—Wenderoth, Lind & Ponack

[57] ABSTRACT

A carbonizing chamber is charged with powdered coal, and then the powdered coal is loaded down with a predetermined load from above with vibration to control the packing density of the powdered coal by means either of a pressing and vibrating member provided on a leveling beam body or a beam body arranged to act also as a pressing and vibrating member.

7 Claims, 22 Drawing Figures

HEIGHT OF OVER 7m, MODEL TEST

APPARATUS FOR FILLING CARBONIZING CHAMBER OF COKE OVEN WITH POWERED COAL WITH VIBRATION APPLIED THERETO

This is a division of application Ser. No. 199,038, filed Oct. 20, 1980, now abandoned.

BACKGROUND OF THE INVENTION

1. Field of the Invention

This invention relates to an apparatus in which powdered coal put in the carbonizing chamber of a coke oven is controlled to have a homogeneous and optimum packing density.

2. Description of the Prior Art

It has been known both in theory and by experience that the strength of carbonized coke can be improved by increasing the packing density of the coal with which the carbonizing chamber of a coke oven is charged because the distance between the coal particles is decreased with the increase in packing density.

Heretofore, the carbonizing chamber has been charged with coal from above by a natural dumping operation. By this practice, the packing density of the coal mass decreases in an upper part of the chamber while the coal mass in the lower part of the chamber has a high degree of packing density because of the weight of the coal. Such uneven distribution of packing density results in uneven quality of the resultant coke and hinders the improvement in productivity. Particularly, where weakly caked coal is used, such uneven packing density distribution results in coke of low breaking strength. When such coke is charged into a blast furnace as a reducing agent for the production of pig iron, the increased proportion of powdered coke makes it difficult to obtain desired air- and liquid-transmissibility and thus lowers the productivity in the operation of the blast furnace.

The outline of a large scaled industrial coke oven facility is as illustrated in the accompanying drawings of FIGS. 1 and 2. Each carbonizing chamber A in such a coke oven, for example, measures 0.4 to o.5 m in width, 5 to 6 m in height and 14 to 15 m in distance between the back and front sides thereof. On both the front and back sides, there are provided doors 1 and 2. In the upper part of the chamber, there are provided four to five powdered coal charging inlets 3. With each of the carbonizing chambers arranged in this manner, burning chambers are disposed between adjacent carbonizing chambers to form an oven group which includes 80 to 100 chambers arranged in parallel. A powdered coal charging cart C which has a number of powdered coal hoppers corresponding to the powdered coal charging inlets 3 of the carbonizing chamber A is arranged to travel on the upper part of the oven group in the direction of the width of the carbonizing chambers A and thus to charge each carbonizing chamber with the powdered coal up to about 80% of the inside height of each carbonizing chamber A. The powdered coal thus forms an uneven surface 5 with the tips of the protrusions of the uneven surface located immediately below the charging inlets 3 of each chamber while the angle of repose of the powdered coal surface is 36° to 40°.

On the rear side of the coke oven group, there is provided a travelling truck F. On the truck F, there are provided a leveler D for leveling off the uneven surface 5 of the charging powdered coal and a pusher E which is arranged for pushing out produced coke from each carbonizing chamber A. The leveler is disposed above the pusher E and levels D off the above stated uneven surface 5 of the charging powdered coal by repeating its movement back and forth from the rear side to the front side and vice versa after each chamber is charged with the powdered coal. This back-and-forth movement of the leveler D is performed for the purpose of securing a passage for a generated gas by leveling the uneven surface of the powdered coal. The accompanying drawing FIG. 3 shows one example of the leveler. In this example, the leveler D is provided with a beam body 8 which has a sufficient length to move in and move out covering the entire length of the carbonizing chamber A and is composed of two side plates 9 and parting strips 10 arranged and suitably spaced between the two side plates 9. Several pairs of guide rollers 11 are arranged to horizontally carry and guide the beam body 8. A driving means 12 is arranged to move the beam body 8 back and forth through a small doorway provided in the upper part of the back door 2 of the carbonizing chamber A. The beam driving means 12 comprises a driving drum 13 disposed on the travelling truck F, front and rear fixed guide sheaves 14, and an endless rope 15 which is wound round these guide sheaves 14. The endless rope 15 is fastened by a clip 16 to the rear part of the beam body 8, so that the beam body 8 can be moved into and out of the carbonizing chamber A over the entire length thereof by causing the driving drum 13 to rotate in the normal and reverse directions. Then the parting strips 10 rake the uneven surface 5 of the powdered coal to effect leveling thereof as the beam body 8 moves back and forth.

The pusher E which is disposed below the leveler D is arranged such that, after coke is produced, the front and back doors 1 and 2 of the carbonizing chamber A are opened, and then the pushing ram 17 of the pusher E is pushed into the carbonizing chamber A to cause the produced coke to be discharged to a quenching cart H through a coke guide cart G disposed on the side of the front door 1.

The arrangement of the coke oven facility is as described in the foregoing. The hardness of the carbonized coke which is obtained from such a coke oven can be improved by increasing the packing density of the charging powdered coal. This has been known both in theory and by experience because the distance between coal particles decreases as the packing density increases. With powdered coal of particle size 3 mm, under 85%, having a water content of 8% used as sample, an experiment has been conducted to see the relation of the packing density in ton/m$^3$ to various values of heaping depth in m obtained by varying the falling height from the charging inlet. The accompanying drawing FIG. 4 shows the results of the experiment. As shown in FIG. 4(*a*), the packing density increases as the falling height increases and as the heaping depth increases. The relation of charging depth in m to the cold hardness index $DI_{15}{}^{150}$ (%) of coke obtained from a test oven and the relation of the packing density in ton/m$^3$ to the cold hardness index of the coke $DI_{15}{}^{150}$ (%) are as shown in FIGS. 4(*b*) and (*c*). As shown, the hardness of the coke produced by the coke oven increases as the packing density of the powdered coal increases.

Heretofore, charging the carbonizing chamber of a coke oven with powdered coal has been carried out by natural dumping from above as mentioned in the foregoing. Then, the packing density of the powdered coal is greater in the lower part of the carbonizing chamber because of a greater falling height and the consolidating action caused by the heaping weight of the powdered coal, and the packing density decreases in the powdered coal located in the upper part of the carbonizing chamber. This uneven packing distribution within the coke oven causes unevenness in the hardness and quality of the coke produced and thus makes improvement in productivity hardly possible. Particularly, when weakly caked coal is used, the breaking strength of the coke obtained therefrom is so low that, when it is used as a reducing agent in a blast furnace, the powderizing rate thereof increases to make air and liquid transmissibility hardly retainable and the productivity of the blast furnace operation becomes too low.

SUMMARY OF THE INVENTION

A general object of this invention is to provide an apparatus which advantageously solves the above stated problem by controlling the packing density of powdered coal with which the carbonizing chamber of a coke oven is filled and charged, to ensure that the density thereof is uniformly high. The feature of the apparatus lies in that a predetermined degree of load is applied with vibration to the powdered coal with which the carbonizing chamber is charged. The powdered coal is densely packed within the carbonizing chamber by applying gravity and vibration thereto as a physical force to have the packing density of the coal powder distributed uniformly and to a high degree in all directions within the carbonizing chamber, so that coke which is of high breaking strength and is capable of contributing to improvement in productivity can be manufactured.

It is a more specific object of the invention to provide an apparatus for filling the carbonizing chamber of a coke oven with powdered coal wherein the powdered coal with which the carbonizing chamber is charged is arranged to have its packing density controlled by vibration under a predetermined degree of load which is applied from above to the powdered coal.

It is another object of the invention to provide an apparatus for filling the carbonizing chamber of a coke oven with powdered coal, wherein the powdered coal with which the carbonizing chamber is charged is vibrated while a predetermined load is applied to the surface of the powdered coal after the chamber is charged with the coal up to a certain predetermined height. Then, the chamber further is charged with coal and the above stated packing again is carried out to have the packing density of the powdered coal uniformly distributed throughout the entire height of the powdered coal.

It is a further object of the invention to provide an apparatus for filling the carbonizing chamber of a coke oven with powdered coal, wherein the apparatus has a beam body which is arranged to be capable of moving into and out of a carbonizing chamber of the coke oven covering the entire length of the carbonizing chamber in contact with the surface of the powdered coal after the coal has been placed inside of the chamber and after the surface has been leveled. A pressing-vibrating member is pivotally attached at least to a fore end part of the beam body to be bendable relative to the beam body and is provided with a pressing-vibrating face and a pulling-up arm. An air vibrator is attached to the pressing-vibrating member. A and a pull-up driving means is attached to the rear end of the beam body and is operatively connected to the pulling-up arm of the pressing-vibrating member through a traction member.

It is a still further object of the invention to provide a pressing-vibrating filling apparatus for filling a coke oven with powdered coal. The apparatus has a beam body which is movable into and out of the carbonizing chamber of the coke oven covering the entire length of the chamber in contact with the surface of the powdered coal after the carbonizing chamber has been charged with the powdered coal and after the uneven surface of the coal has been leveled, the beam body being provided with pressing-vibrating bottom plates which are arranged at least on the lower side of the beam body at least with suitable spacing in the longitudinal direction thereof. A beam depressing means is arranged to depress the beam body keeping it in a horizontal posture after the beam body has entered the carbonizing chamber. A vibrator is attached to the rear end of the beam body.

An additional object of this invention includes the provision of an apparatus for filling the carbonizing chamber of a coke oven with powdered coal with vibration. The apparatus has a beam body which is arranged to be movable into and out of the carbonizing chamber covering the entire length of the chamber in contact with the surface of the powdered coal after the coal has been placed inside of the chamber and after the surface of the coal has been leveled. A vibrating member is pivotally attached at least to a fore end part of the beam body to be bendable relative to the beam body and is provided with a pressing-vibrating face and a pulling-up arm. A vibrator is attached to the rear end part of the beam body and is rigidly connected through a rod to the pulling-up arm of the vibrating member. A pull-up driving means is attached to the rear end of the beam body and is arranged to pull up the vibrating member through the rod.

These and further objects, features and advantages of the invention will become apparent from the following detailed description of embodiments thereof taken in connection with the accompanying drawings.

BRIEF DESCRIPTION OF THE DRAWINGS

FIG. 6 showing the relation of packing density to the depth of coal under a constant vibrating condition and varied packing pressure; and FIG. 7 showing the relation of the packing density to vibrating time obtained at different depths of the coal.

DETAILED DESCRIPTION OF PREFERRED EMBODIMENTS

Figure 5:
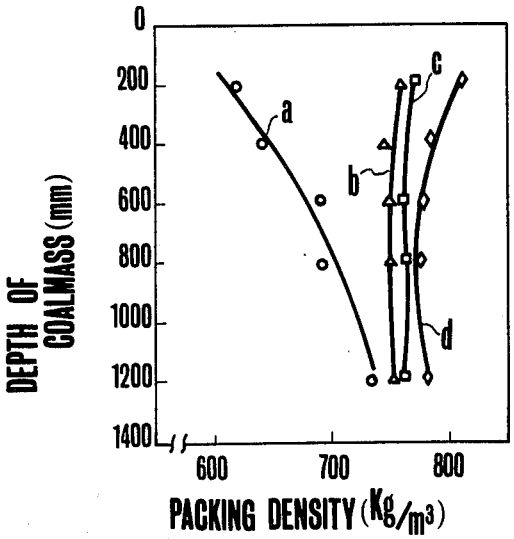
FIGS. 5, 6 and 7 are graphs showing the results of tests conducted in accordance with the present invention, FIG. 5 showing the relation of packing density to the depth of coal under constant packing pressure with varied vibrating conditions.
Figure 6:
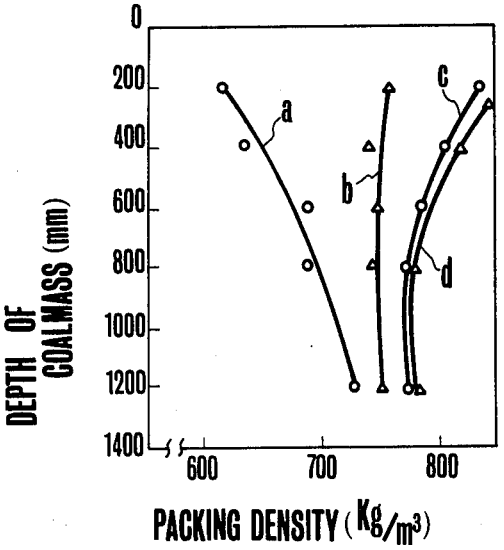

Experiments are conducted using a model apparatus at an unvarying packing pressure of $1.58\times10^{-2}$ kg/cm$^2$. Vibration is applied at 3,600 VPM with vibration acceleration of 2 m/sec$^2$ for varied periods of time. FIG. 5 shows the relation of packing density to the depth of the powdered coal placed within the carbonizing chamber of the model. In FIG. 5, a curve a represents a test conducted without giving any vibration; a curve b represents a test conducted with vibration given for a period of 10 sec; another curve c represents a test conducted with vibration given for 30 sec; and a curve d represents a test conducted with vibration given for 300 sec. FIG. 6 shows results of tests conducted with the same model by varying the packing pressure while the vibration applying period of time is fixed at 10 sec to see the relation of the packing density to the depth of the powdered coal under such conditions. In FIG. 6, a curve a indicates results of a test conducted under no packing pressure (i.e. packing is effected solely by the coal weight); a curve b represents results of a test conducted under a packing pressure of $1.58\times10^{-2}$ kg/cm$^2$; a curve c represents results of a test conducted under a packing pressure of $3.24\times10^{-2}$ kg/cm$^2$; and another curve d represents results of a test conducted under a packing pressure of $4.33\times10^{-2}$ kg/cm$^2$.

Figure 7:
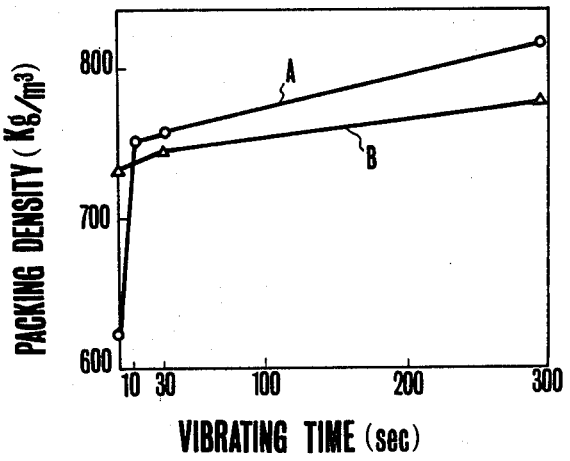

FIG. 7 shows results of tests conducted with the same model under a packing pressure of $1.58\times10^{-2}$ kg/cm$^2$, with vibration at 3,600 VPM and acceleration of 2 m/sec$^2$ to see the relation of the packing density to the vibrating time in the upper and lower areas of the powdered coal within the carbonizing chamber. In FIG. 7, a curve A represents the relation in the upper area which measures 200 mm in depth while another curve B represents the relation in the lower area measuring 1,200 mm in depth.

As is apparent from the results of the tests described in the foregoing, the powdered coal filling operation is preferably carried out under a packing pressure of $1.0\text{–}2.0\times10^{-2}$ kg/cm$^2$ and a vibrating time of 10 to 50 sec with vibration carried out at 3,600 VPM with acceleration of 1 to 3 m/sec$^2$.

Further, the powdered coal filling operation may be more effectively carried out with fluidity increased to increase the overall degree of packing density by adding to the powdered coal some additive such as heavy oil which also serves to increase the heat of the coke oven gas. The use of such an additive along with the application of vibration permits effective filling with a light load and light vibration.

However, there is a limit to the extent of the depth over which a dense packing effect is attainable by applying pressing and vibrating forces from above the surface of the powdered coal. Where the height of the coke oven exceeds 7 meters, uniform packing density sometimes cannot be obtained throughout the entire depth from the bottom to the top of the powdered coal placed within the carbonizing chamber. In such a case where a desired dense packing effect cannot be attained by carrying out the pressing-vibrating operation only once, therefore, the problem is solved by the following. After the powdered coal is put in the carbonizing chamber of the coke oven to a predetermined height within the chamber, a packing operation is carried out by applying a vibrating force under a predetermined load applied to the surface of the powdered coal. After that, this packing operation is repeated alternately with the operation of putting the powdered coal into the carbonizing chamber. The packing density in this manner can be made almost uniform over the entire height of the powdered coal placed within the carbonizing chamber.

Figure 8:
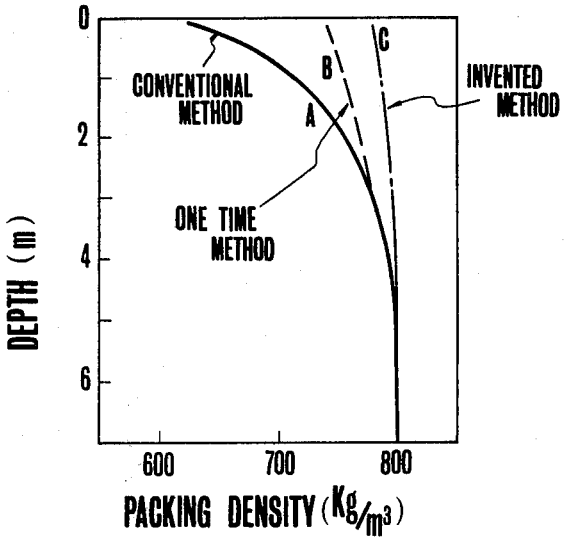
FIG. 8 is a graph showing the results of tests conducted with a model measuring 7 m in height to find the relation of the packing density of powdered coal to the filling depth of the powdered coal.

FIG. 8 shows the relation of the packing density to the depth of the powdered coal placed within the carbonizing chamber as found from a model coke oven measuring 7 m in height. In FIG. 8, a curve A represents the conventional method in which leveling is performed after the powdered coal is put in up to a height of 7 m by natural falling; a curve B represents a one-time method in which the powder is put in up to the full height of 7 m and then is subjected only once to the pressing-and-vibrating packing operation; and another curve C represents the above stated procedure in which a first pressing-and-vibrating packing operation is performed after the powdered coal is put in up to a height of 3.5 m and then a second pressing-and-vibrating packing process is performed after the powdered coal is further put in up to the full height of 7 m. As is apparent from FIG. 8, in accordance with the latter method, the packing density is nearly uniformly distributed over the entire height of the powdered coal.

An apparatus according to the present invention is as described below with regard to first and second embodiments thereof.

Figure 9:
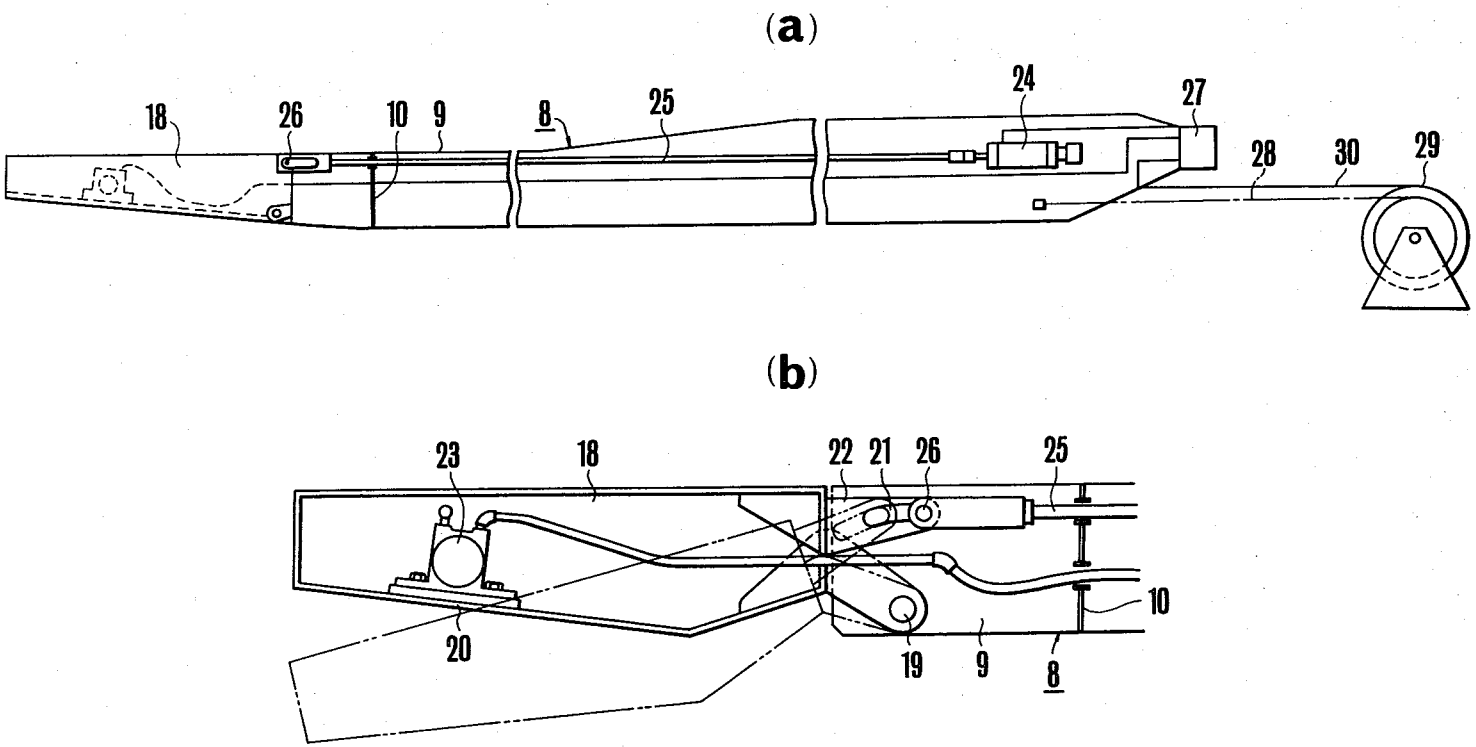
FIGS. 9(*a*) and (*b*) are side views showing the essential parts of a first embodiment of the present invention.
Figure 10:
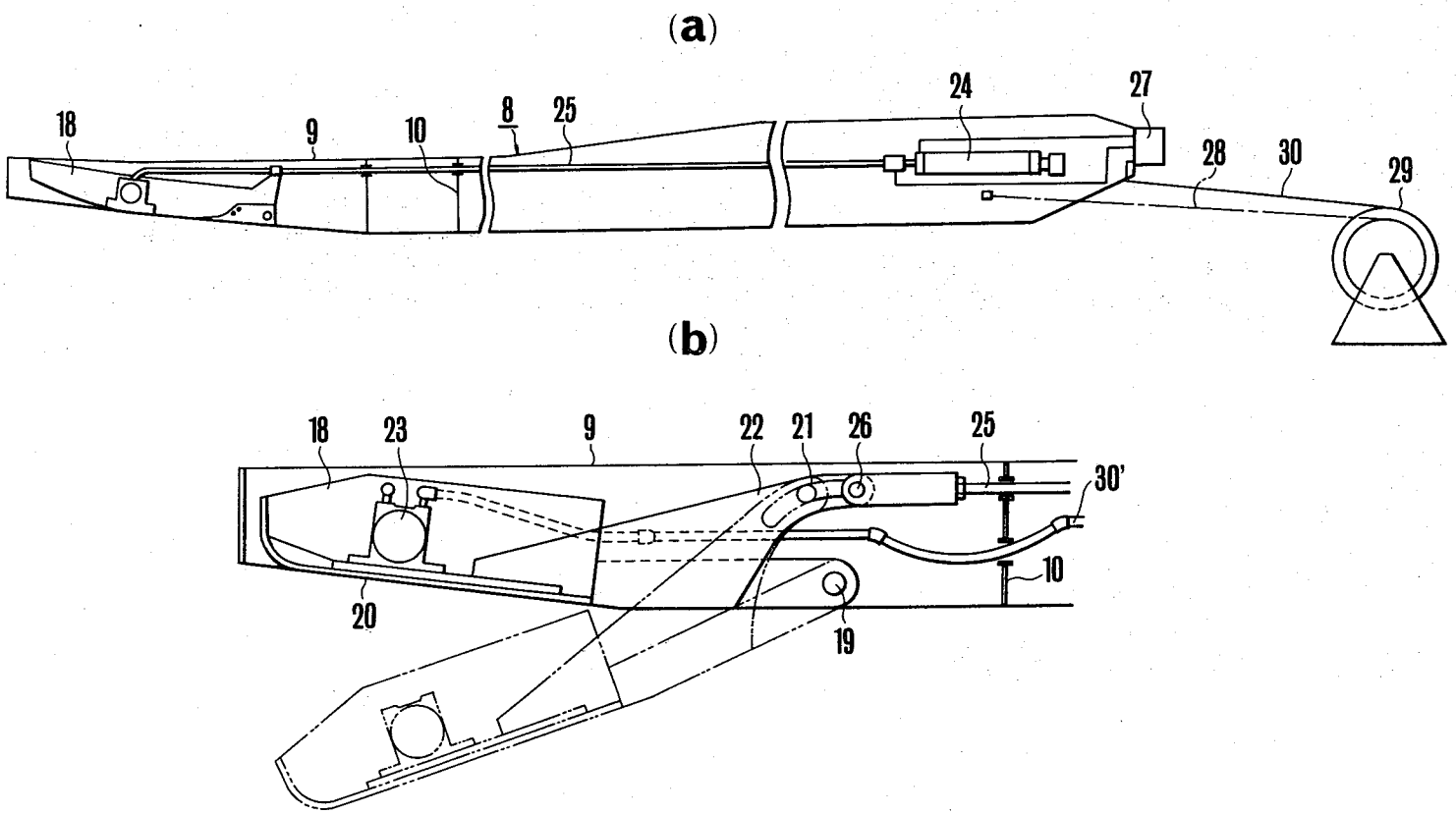
FIGS. 10(*a*) and (*b*) are side views showing the essential parts of a second embodiment of the invention.

The first and second embodiments of the invention are as shown in FIGS. 9(*a*) and (*b*) and FIGS. 10(*a*) and (*b*). A beam body 8 is formed by two long side plates 9 and parting plates 10 which are attached to the side plates 9 with suitable spacing therebetween to form thereby plural bottomless sections. At the fore end of the beam body 8, there is provided a vibrating member 18 which is pivotally connected to the beam body 8 by a pivoting shaft 19 at its lower rear end in a bendable and raisable manner. The vibrating member 18 is provided with a bottom plate 20 which has a pressing-vibrating face for the powdered coal and a pull-up arm 22 which has a slot 21. On the upper surface of the bottom plate 20, there is disposed an air vibrator 23. At the rear end of the beam body 8, there is provided a cylinder 24 for pulling up the vibrating member 18 by pulling a traction rod 25. The traction rod 25 has a pin 26 which is disposed at the fore end of the traction rod and is inserted through the slot 21 of the pull-up arm 22 of the vibrating member 18. The traction rod 25 may be arranged to serve also as air supply pipe for supplying the air vibrator 23 with air pressure. However, since the traction rod is required mainly to perform a pulling function as traction member, the rod may be replaced with a wire rope.

The above stated cylinder 24 is arranged to be operated by compressed air supplied through a solenoid valve 27 and in turn to cause the traction rod 25 either to move and pull upward the vibrating member 18 into alignment with the beam body 8 or to allow the vibrating member 18 to bend down to an extent defined by the slot 21 provided in the pull-up arm 22. Meanwhile, air pressure is arranged to be supplied to the air vibrator 23 through an air hose 30 which is arranged to be taken up and out on and from a wind-up drum 29 together with a wind-up cable 28 or is arranged to be supplied through an air pipe 30'. With the air pressure supplied, the vibrator is capable of imparting vibration to the vibrating member 18. The vibrating member may be arranged into a form of a sealed container to accommodate the air vibrator 23 therein. In the arrangement shown in FIG. 9, the fore end portion of the beam body 8 is simply arranged to serve as the vibrating member. Whereas, in the case of FIG. 10, the vibrator 23 is arranged to be stowable within a fore-end section of the beam body 8. When the vibrating member 18 is released from the pulling action of the traction rod 25, the total weight of the vibrating member 18 including the air vibrator 23 depresses the leveled surface of the powdered coal through the bottom plate 20 of the vibrating member and then the air vibrator 23 is operated to impart vibration to the powdered coal as desired. Further, exhaust air from the air vibrator 23 is utilized to cool the vibrating member.

Figure 1:
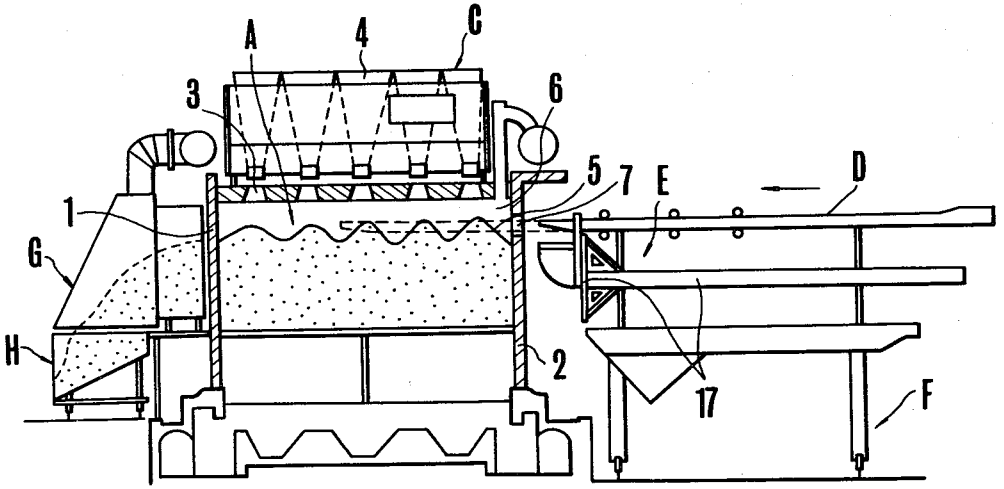
FIGS. 1 and 2 are a side view and a plan view showing the outline of a coke oven facility.
Figure 2:
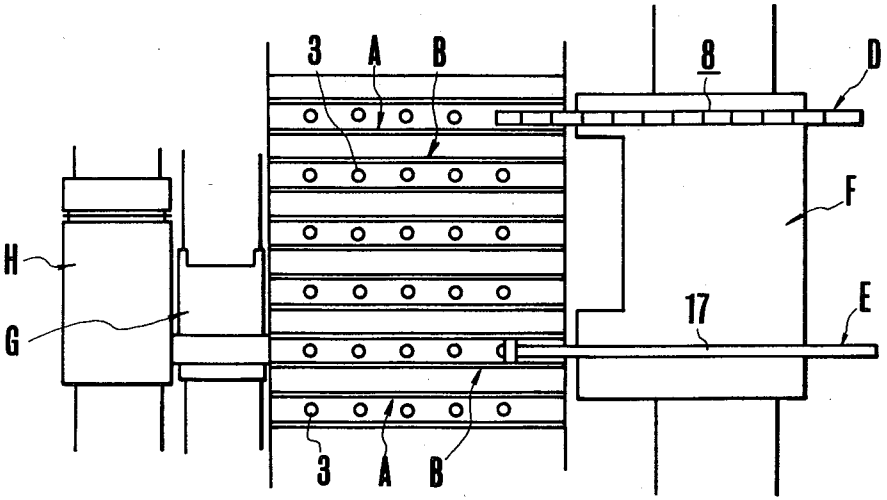
Figure 3:
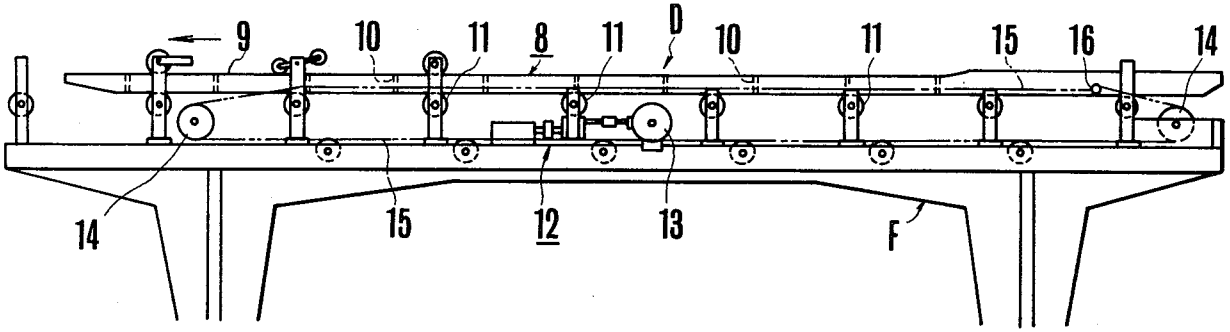
FIG. 3 is a side view showing an example of a conventionally known leveler.
Figure 4:
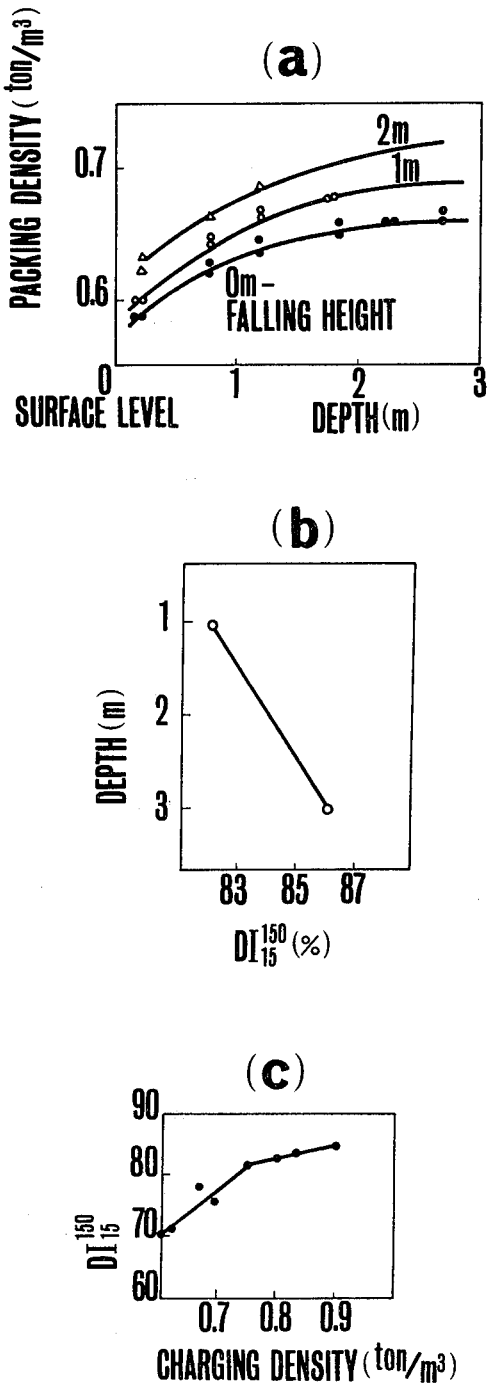
FIGS. 4(*a*), and (*b*) and (*c*) are graphs showing the results of cold model tests.

The powdered coal filling apparatus for filling the carbonizing chamber with the powdered coal with vibration which is arranged as described in the foregoing operates in the following manner: The powdered coal which is put inside of the carbonizing chamber A of the coke oven has uneven surface 5 with the top of each cone-shaped swell being located immediately below each of the charging inlets 3. This uneven surface first must be leveled off. For this leveling, the vibrating member 18 is pulled up into alignment with the beam body 8. Then, as shown in FIG. 3, the beam driving means 12 consisting of the driving drum 13 and the endless rope 15 is operated to move the beam body 8 into and out of the carbonizing chamber A covering the entire length of the chamber A. The cone-shaped swells are crumbled away by the beam body 8 and the surface of the powdered coal is raked to level it. After the leveling action is repeated two or three times, the vibrating member 18 is released from its pulled-up posture and is allowed to bend down onto the surface of the leveled surface of the powdered coal. While a depressing force is thus exerted on the powdered coal by the weight of the vibrating member 18, the air vibrator 23 is operated to have the vibrating member 18 impart a vibrating force to the surface of the powdered coal. In the meantime, the beam body 8 is moved toward the outside of the carbonizing chamber A while the coal is pressed and vibrated in this manner. It goes without saying that the powdered coal packing pressure to be exerted by the vibrating member 18, the number of vibrations and acceleration thereof and the moving speed of the beam body 8 are suitably determined to ensure that the packing density of the powdered coal in the upper part of the carbonizing chamber A becomes nearly equal to the packing density in the lower part of the chamber A.

Figure 11:
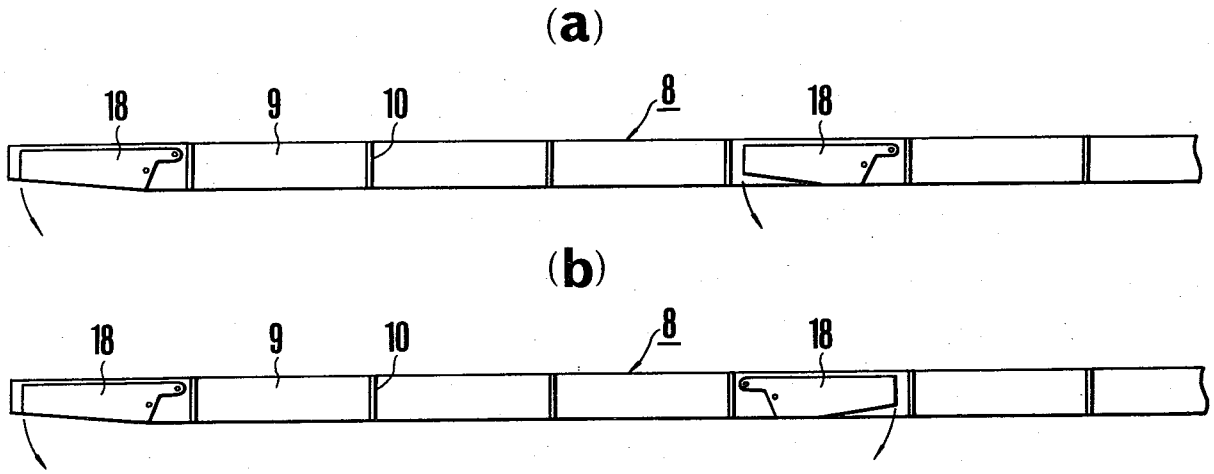
FIGS. 11(*a*) and (*b*) are schematic side views showing another embodiment of the invention wherein two vibrating members are used.

In this particular embodiment of the apparatus shown in FIGS. 9(*a*) and (*b*) and FIGS. 10(*a*) and (*b*), the beam body 8 is arranged to serve also as the leveler beam with one vibrating member 18 disposed at the fore end part thereof. It is possible, however, to provide the beam body 8 separately from a leveler beam. Further, as shown in FIGS. 11(*a*) and (*b*), two or more than two vibrating members 18 may be provided on the beam body 8 to speed up the vibration packing operation.

Figure 12:
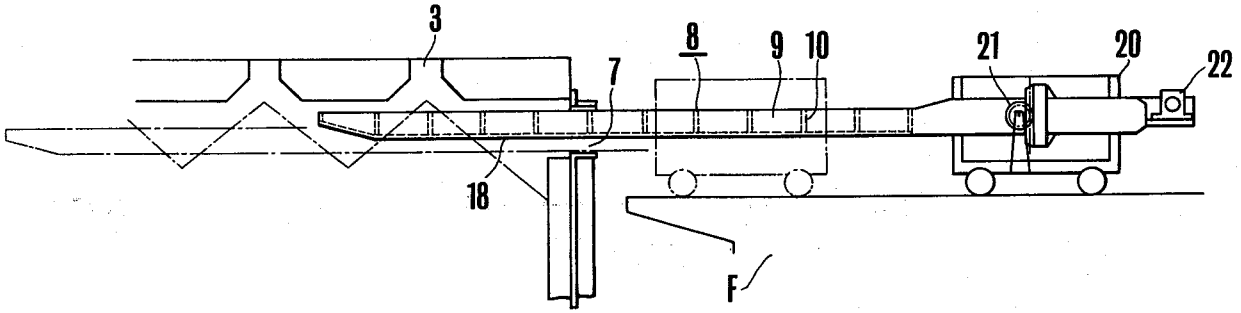
FIG. 12 is a side view showing a third embodiment of the invention.
Figure 13:
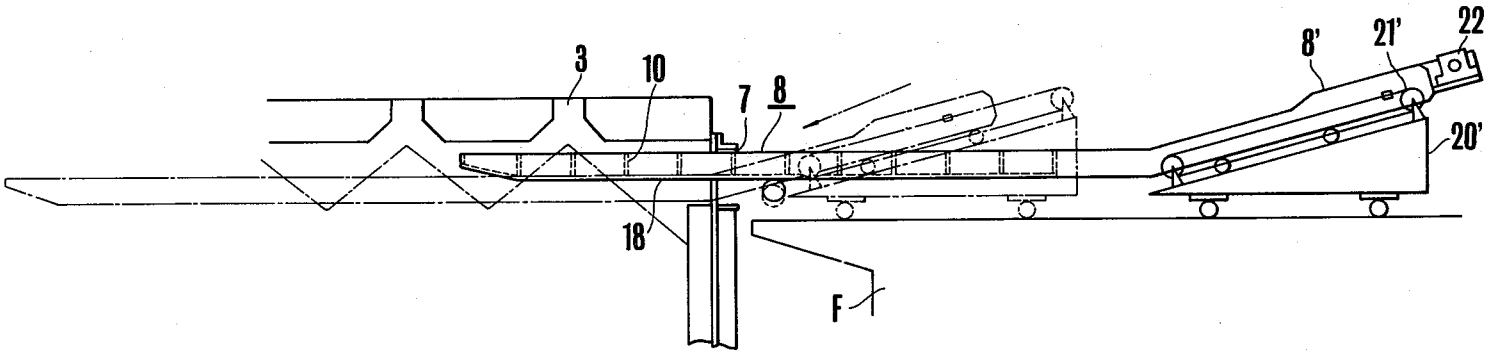
FIG. 13 is a side view showing a fourth embodiment of the invention.
Figure 14:
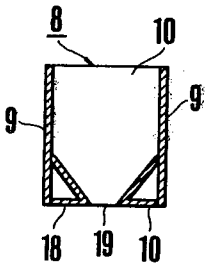
FIG. 14 is an enlarged sectional view showing a beam body.

Third and fourth embodiments of the invention are as shown in FIGS. 12 and 13, in which a beam body 8 is formed by two long side plates 9 and parting plates 10 which are attached to the side plates 9 with suitable spacing therebetween to form thereby plural bottomless sections. On the bottom side of the beam body 8, there are provided pressing-vibrating bottom plates 18 which are arranged either covering the entire bottom side of the beam body 8 or with suitable spacing. Each bottom plate 18 is provided with an opening 19 which is arranged as shown in FIG. 14 to ensure that no powdered coal remains within the enclosure of the beam body 8 when the bottom plate is used for leveling the surface of the powdered coal.

In the case of FIG. 12, the rear end portion of the beam body 8 is disposed within a travelling truck and is arranged to be movable upwardly and downwardly by an up-and-down driving device 21. The beam body 8 is provided with a vibrator 22 which is arranged to be driven either by an air motor or an electric motor. In the embodiment shown in FIG. 13, the rear portion of the beam body 8 is formed into a bending part 8' which is movably mounted on a slanting travelling truck 20'. There is provided a suitable driving means 21' for moving the beam body 8 relative to the slanting travelling truck 20'.

After the beam body 8 has been moved into the carbonizing chamber A of the coke oven by the same beam driving means 12 as shown in FIG. 3, the up-and-down driving device 21 or the driving means 21' is operated to have the beam body 8 descend upon the leveled surface of powdered coal within the carbonizing chamber A with the beam body 8 being kept in a horizontal posture.

In leveling the surface of the powdered coal, the beam body 8 is fixed by clamping to the travelling truck 20 or 20' and then the beam driving means 12 which consists of the driving drum 13 and the endless rope 15 as shown in FIG. 3 is operated to move the beam body 8 into and out of the carbonizing chamber A covering the full length of the carbonizing chamber A. After the leveling action is performed two or three times, the beam body 8 is released from the clamped connection to the travelling truck 20 or 20' and is allowed to descend to depress the leveled surface of the powdered coal by operating the up-and-down driving device 21 or the driving means 21'. The vibrator 22 which is attached to the rear part of the beam body 8 is operated either concurrently with the descent of the beam body 8 or after the descent to pack the powdered coal with pressure and vibration. The upper part of the powdered coal is pressed down by about 200 mm by this packing operation. The vibrating force of the vibrator 22 attached to the rear part of the beam body 8 which always remains outside of the carbonizing chamber is transmitted to the whole of the beam body 8 to carry out the pressing and vibrating operation on the surface of the powdered coal within a relatively short period of time. Upon completion of the pressing and vibrating operation on the powdered coal within the carbonizing chamber A, the up-and-down driving device 21 or the driving means 21' is operated to lift the beam body 8 off the powdered coal surface. Then, the beam driving means 12 is operated to move the beam body 8 out of the carbonizing chamber A by moving it together with the truck 20 or 20'. At this time, the opening 19 which is provided in the pressing and vibrating bottom plate 18 of each section of the beam body 8 ensures that the powdered coal can be effectively prevented from being left within each section of the beam body 8.

In each of the apparatuses shown in FIGS. 12 and 13, the beam body 8 is arranged to serve also as the leveler beam. However, it is possible to have the beam body 8 arranged separately from a leveler beam. In that instance, it is not necessary to have the opening 19 in the pressing and vibrating bottom plate 18 of the beam body 8.

Figure 15:
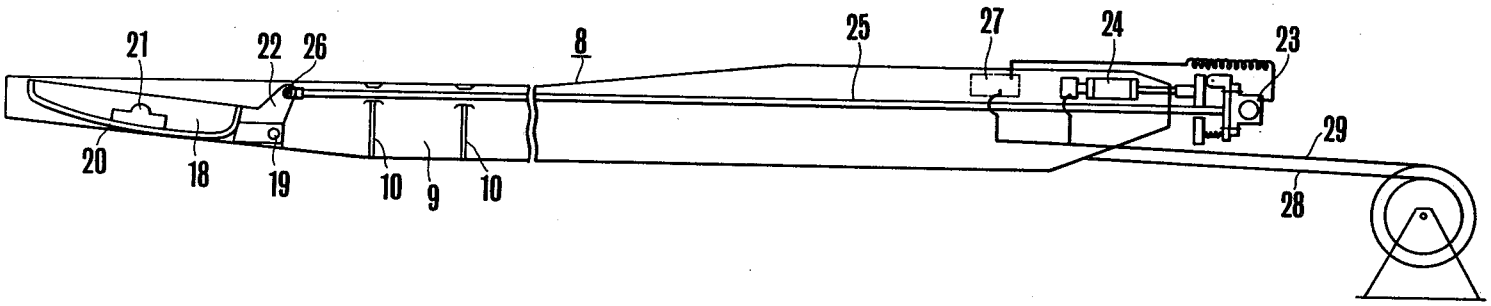
FIG. 15 is a side view showing the essential parts of a fifth embodiment of the invention.

Another embodiment of the apparatus of the invention is as shown in FIG. 15, in which a beam body 8 consists of plural bottomless sections which are formed by side plates 9 and parting plates 10. At the fore end of the beam body 8, there is provided a vibrating member 18 the lower rear end of which is pivotally connected to the fore end of the beam body 8 by a pivot shaft 19. The vibrating member 18 has a bottom plate 20 which serves as a pressing and vibrating face for the powdered coal; a pull-up arm 22; and a weight 21 which is arranged on the bottom plate 20 to exert an additional pressing force on the powdered coal if necessary.

At the rear end of the beam body 8, which always remains outside of the carbonizing chamber of the coke oven, there are provided a vibrator 23 which is arranged to be driven by either an air motor or an electric motor or some other suitable means and a cylinder 24 which is arranged to pull up the vibrating member 18. A rod is rigidly connected to the vibrator 23 while the fore end of the rod 25 is connected to the above stated pull-up arm 22 of the vibrating member 18 through a pin 26. This rod 25 serves to transmit the vibration produced by the vibrator 23 to the vibrating member 18. Meanwhile, the above stated cylinder 24 is operatively connected to the vibrating member 18, so that the vibrating member 18 can be pulled upwardly by the rod 25 to have it in alignment with the beam body 8 by operating the cylinder 24.

Figure 16:
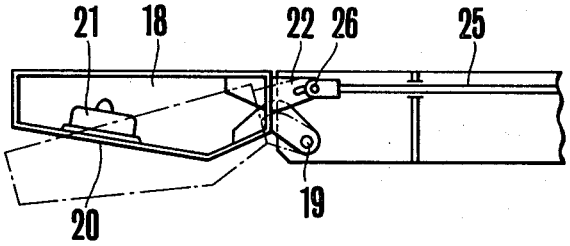
FIG. 16 is a side view showing the essential parts of a sixth embodiment of the present invention.

In the case of FIG. 15, the vibrating member 18 is formed into a box-like shape and is arranged to be stowable within the fore end section of the beam body 8. However, this arrangement may be replaced with an arrangement as shown in FIG. 16 in which the fore end section of the beam body 8 is used to serve as the vibrating member by itself. Further, it is also possible to have a plurality of vibrating members 18 arranged as shown in FIG. 11.

The cylinder 24 is arranged to be operated by compressed air supplied through a solenoid valve 27 in such a way as to pull up the vibrating member into alignment with the beam body 8 or to let it bend down by moving the rod 25.

With the vibrating member allowed to bend down by the operation of the cylinder 24, the leveled surface of the powdered coal within the carbonizing chamber A of the coke oven is subjected to a depressing force exerted by the total weight of the vibrating member including the weight 21. Then, a vibrating force can be imparted to the powdered coal by operating the vibrator 23 as required.

Figure 17:
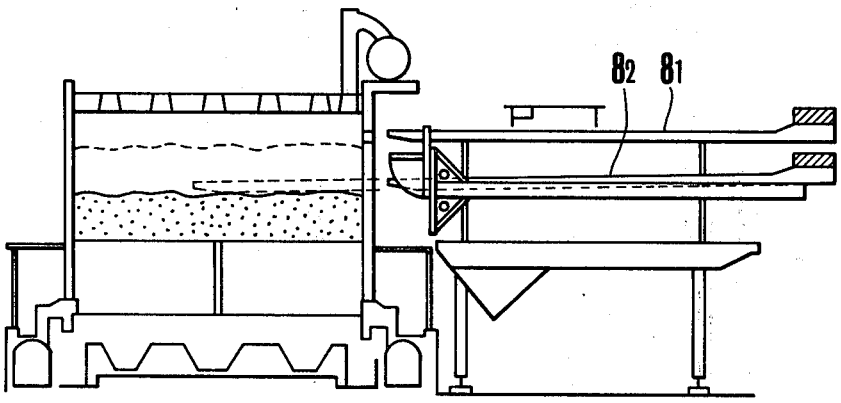
FIG. 17 is a schematic illustration showing an embodiment of the apparatus of the invention adapted for carrying out a filling method employing the present invention in two steps.

FIG. 17 shows a further embodiment of the apparatus of the invention which is adapted for an application where the height of the coke oven is too great to obtain uniform packing density distribution from the bottom part to the upper part of the powdered coal with which the carbonizing chamber of the coke oven is charged. This embodiment is arranged to perform the pressing-vibrating packing operation in two steps. The structure of this apparatus may be arranged in the same manner as in the apparatus described in the foregoing with the exception of that, in this case, there are provided beam bodies $8_1$ and $8_2$ which are arranged in two stages.

Using an apparatus arranged in accordance with this embodiment, an experimental vibration packing operation was conducted on powdered coal placed within the carbonizing chamber of a coke oven measuring 32 $m^3$. The packing pressure exerted on the surface of the powdered coal was $1.56\times10^{-2}$ kg/cm$^2$, the number of vibrations was 3,600 VPM, the vibration acceleration was 1.5 m/sec$^2$ and the vibration applying period of time 30 sec. The results of the experiments were:

The packing density increases by 0.1 ton/m$^3$ in the area from the surface down to a depth of 1 m and the hardness $DI_{15}{}^{150}$ (%) of coke obtained in this area increases by 2.85% while the powderizing rate of the coke obtained there decreases by 2.88%.

What is claimed is:

1. An apparatus for filling the carbonizing chamber of a coke oven with powdered coal and for applying vibration thereto, said apparatus comprising:

a beam body arranged and constructed to be movable into and out of a carbonizing chamber of a coke oven, throughout the entire length of the carbonizing chamber, in contact with the surface of powdered coal after the carbonizing chamber is charged with the powdered coal and after the surface of the powdered coal is leveled;

a vibrating member pivotally connected at least to the fore end of said beam body to be bendable relative to said beam body, said vibrating member including a pressing and vibrating face for contacting the surface of the powdered coal and a pull-up arm;

pull-up driving means, attached to the rear end of said beam body and operatively connected to said pull-up arm, for enabling said vibrating member to bend relative to said beam body; and vibrating means attached to said vibrator member to vibrate the same and thereby apply vibrations to the surface of the powdered coal.

2. An apparatus as claimed in claim 1, wherein said beam body is arranged and constructed to serve also as a leveler beam to level the surface of the powdered coal in the carbonzing chamber, said beam body includes a framework-like section, and said vibrating member is mounted on said beam body to be stowable in said framework-like section.

3. An apparatus as claimed in claim 1, wherein said vibrating means comprises an air vibrator.

4. An apparatus as claimed in claim 1, wherein said driving means comprises a fluid cylinder system mounted on said rear end of said beam body, and a traction member movable by said cylinder system and connected to said pull-up arm.

5. An apparatus as claimed in claim 1, wherein said vibrating member is pivotable between an inoperative position in alignment with said beam body and an operative position bending downwardly with respect to said beam body to press downwardly on the surface of the powdered coal.

6. An apparatus for filling the carbonizing chamber of a coke oven with powdered coal and for applying vibration thereto, said apparatus comprising:

a beam body arranged and constructed to be movable into and out of a carbonizing chamber of a coke oven, throughout the entire length of the carbonizing chamber, in contact with the surface of powdered coal after the carbonizing chamber is charged with the powdered coal and after the surface of the powdered coal is leveled, said beam body including plural pressing and vibrating bottom plates arranged in the longitudinal direction of said beam body and spaced therealong at least on the lower side of said beam body, a rear portion of said beam body being bendable;

means for, after said beam body is moved into the carbonizing chamber, lowering said beam body such that said bottom plates are moved into pressing contact with the surface of the powdered coal in the carbonizing chamber, while maintaining said beam body in a horizontal posture, said lowering means comprising a forwarding and retracting truck having an inclined portion, said bendable rear portion of said beam body being positioned on said inclined portion of said truck, and means for moving said bendable rear portion of said beam body along said inclined portion of said truck, thereby lowering said beam body; and vibrating means attached to a rear end part of said beam body for vibrating said bottom plates and thereby applying vibrations to the surface of the powdered coal.

7. An apparatus as claimed in claim 6, wherein said beam body is arranged and constructed to serve also as a leveler beam to level the surface of the powdered coal in the carbonizing chamber, and each said bottom plate has therein opening means for evacuating therefrom the powdered coal.

* * * * *